US012213512B2

(12) United States Patent
Jin et al.

(10) Patent No.: US 12,213,512 B2
(45) Date of Patent: Feb. 4, 2025

(54) ABNORMALLY-SHAPED TOBACCO GRANULES AND PREPARATION METHOD THEREOF, TOBACCO PRODUCT AND PREPARATION METHOD THEREOF

(71) Applicant: CHINA TOBACCO HUNAN INDUSTRIAL CO., LTD., Hunan (CN)

(72) Inventors: Yong Jin, Hunan (CN); Qian Chen, Hunan (CN); Ke Li, Hunan (CN); Saibo Yu, Hunan (CN); Hongmei Fan, Hunan (CN); Haifeng Tan, Hunan (CN); Shitai Wang, Hunan (CN); Chao Tan, Hunan (CN); Qi Liu, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 197 days.

(21) Appl. No.: 17/432,859

(22) PCT Filed: Feb. 20, 2019

(86) PCT No.: PCT/CN2019/075540

§ 371 (c)(1),
(2) Date: Aug. 20, 2021

(87) PCT Pub. No.: WO2020/168476

PCT Pub. Date: Aug. 27, 2020

(65) Prior Publication Data

US 2022/0053813 A1 Feb. 24, 2022

(51) Int. Cl.
*A24B 3/14* (2006.01)
*A24B 15/14* (2006.01)
(Continued)

(52) U.S. Cl.
CPC ..... *A24B 3/14* (2013.01); *A24B 15/14* (2013.01); *A24B 15/186* (2013.01); *A24C 5/1807* (2013.01); *A24C 5/1864* (2013.01)

(58) Field of Classification Search
CPC ..... A24B 3/14; A24B 15/14; A24B 15/186; A24C 5/1807; A24C 5/1864
See application file for complete search history.

(56) References Cited

U.S. PATENT DOCUMENTS

| | | | | |
|---|---|---|---|---|
| 10,820,622 | B2 | 11/2020 | Sun et al. | |
| 2013/0160779 | A1* | 6/2013 | Chida | A24F 42/60 131/355 |
| 2013/0340776 | A1* | 12/2013 | Mishra | A24B 15/186 427/299 |
| 2018/0070625 | A1* | 3/2018 | Voss | A24B 3/14 |
| 2018/0295885 | A1* | 10/2018 | Rojo-Calderon | A24D 1/20 |

FOREIGN PATENT DOCUMENTS

| | | | |
|---|---|---|---|
| CN | 101128130 | A | 2/2008 |
| CN | 101272703 | A | 9/2008 |

(Continued)

OTHER PUBLICATIONS

Machine Translation of CN107536095 (Year: 2016).*
International Search Report issued in International Application No. PCT/CN2019/075540 dated Nov. 25, 2019, 2 pages.

*Primary Examiner* — Christopher M Rodd
*Assistant Examiner* — Jennifer A Kessie
(74) *Attorney, Agent, or Firm* — MASCHOFF BRENNAN; Ran Pang; Michael Mauriel

(57) ABSTRACT

Abnormally-shaped tobacco granules are provided. The tobacco granules comprise a tobacco granule body and a coating attached to the surface of the tobacco granule body. The coating contains an adhesive. The surface of the abnormally-shaped tobacco granule has one or more grooves and/or ridges, and/or, the abnormally-shaped tobacco granule has through holes therein. The surface grooves of the abnormally-shaped tobacco granules can serve as smoke channels after the tobacco granules are bonded, cured and (Continued)

shaped, so that the air permeability inside a total-granule tobacco product is greatly improved. The smoking resistance of cigarettes is reduced. The flammability of cigarettes is improved and the consumption of tobacco raw materials is reduced. A preparation method of the abnormally-shaped tobacco granules, a tobacco product comprising the abnormally-shaped tobacco granules, and a preparation method thereof are also provided.

12 Claims, 1 Drawing Sheet

(51) Int. Cl.
*A24B 15/18* (2006.01)
*A24C 5/18* (2006.01)

(56) References Cited

FOREIGN PATENT DOCUMENTS

| | | | |
|---|---|---|---|
| CN | 104905401 | A | 9/2015 |
| CN | 107307466 | A | 11/2017 |
| CN | 107536094 | A | 1/2018 |
| CN | 107536095 | A | 1/2018 |
| CN | 107536096 | A | 1/2018 |
| CN | 108078012 | A | 5/2018 |
| EP | 2606752 | A1 | 6/2013 |
| JP | 2008531008 | A | 8/2008 |
| WO | 2016/097294 | A1 | 6/2016 |
| WO | 2019016535 | A1 | 1/2019 |

* cited by examiner

ABNORMALLY-SHAPED TOBACCO GRANULES AND PREPARATION METHOD THEREOF, TOBACCO PRODUCT AND PREPARATION METHOD THEREOF

CROSS REFERENCE TO RELATED APPLICATIONS

This application is a U.S. National Phase application under 35 U.S.C. § 371 of International Application No. PCT/CN2019/075540 filed on Feb. 20, 2019. The entire content of this application is hereby incorporated herein by reference.

FIELD OF THE INVENTION

The present invention belongs to the field of new tobacco production technology, and specifically relates to abnormally-shaped tobacco granules and a preparation method thereof, a tobacco product and a preparation method thereof.

BACKGROUND OF THE INVENTION

At present, cigarettes are generally produced in the tobacco industry by tobacco shredding, cigarette paper wrapping, and cigarette filter connection. The production technology is mature and fast in production speed, and is thus a general method for producing conventional cigarettes at home and abroad.

With the advances in science and technology and the general increase in people's health consciousness, new tobacco products have been developed dramatically. Low-temperature non-burning cigarettes, as one of the main products, are especially valued by major research institutions and enterprises. At present, the low-temperature non-burning cigarette products on the market mainly use special electric heating devices to fill tobacco materials such as cigarettes, cut tobacco or tobacco slices therein, and the smoke in the tobacco filling materials is volatilized by means of electric heating, so that the smoker obtains a smoking experience similar to that of traditional tobacco. The low-temperature smoke producing body in this form generally has the problems such as insufficient smoke, uneven smoke throughout smoking, easy damage of flexible cigarettes, and the like.

Chinese patent application CN201610470869.1 discloses a preparation method of a homogeneous cigarette, the cigarette is prepared by extruding tobacco granules, a lot of adhesive is used during granulation, even a lot of hot-melt adhesive is used during filter formation of granules, this will bring a great negative impact on smoking, and the gaps between granules as smoke channels inside the cigarette are not enough to prove that the cigarette has a proper smoking resistance; in addition, the strength of granules prepared by one-step drying granulation in this patent is extremely low, which is difficult to meet the requirements of further machining. Chinese patent application CN201510255461.8 discloses a method for preparing a cigarette from tobacco beads, the tobacco beads having a bulk density of 1.2-1.8 g/ml are pressed into the cigarette, the high density causes a sharp decrease in flammability, meanwhile, the weight of the cigarette is far beyond the standard of the existing cigarette, and the resulting harmful ingredients will increase dramatically, which has been proved from a sharp increase in puffs.

Chinese patent publication CN108078012A discloses a heating non-burning tobacco product containing tobacco granules, the prepared tobacco granules are filled into a sleeve with a base and a top cover, the sleeve is provided with air holes, and the overall sleeve is heated in a smoking set to produce smoke, so the preparation process is relatively complicated, and the tobacco product cannot be produced on a cigarette making machine. Chinese patent application CN201710391934.6 discloses a granular heating non-burning tobacco matrix and a preparation method thereof, the prepared tobacco granules are directly loosely filled in a cartridge and heated to produce smoke, this operation is complicated and has great damage to a smoking set, and the smoking set is difficult to clean after smoking, so the experience is poor.

SUMMARY OF THE INVENTION

Aiming at the shortcomings of the prior art, one of the objectives of the present invention is to provide abnormally-shaped tobacco granules and a preparation method thereof to improve the smoking experience; and the other objective of the present invention is to provide a tobacco product prepared from the abnormally-shaped tobacco granules and a preparation method thereof.

Abnormally-shaped tobacco granules include a tobacco granule body and a coating attached to the surface of the tobacco granule; the coating contains an adhesive; and the surface of the abnormally-shaped tobacco granule has one or more grooves and/or ridges, and/or, the abnormally-shaped tobacco granule has through holes therein.

In the presence of grooves, ridges or through holes, the inside of the smoke producing body after the abnormally-shaped tobacco granules are bonded and shaped can have enough pores and channels, which reduces the smoking resistance of a cigarette and improves the thermal conductivity or flammability thereof; in addition, the bulk density of the tobacco granules can be reduced while the strength of the abnormally-shaped tobacco granules is kept, thereby reducing the weight of the cigarette, reducing the consumption of tobacco ingredients, reducing the generation of harmful ingredients such as smoke nicotine, and improving the smoking experience. In addition, the specific surface area of the tobacco granules can also be increased, and the amount of smoke during smoking is also increased.

Further, the mass ratio of the coating to the abnormally-shaped tobacco granule is (0.1-5): 100. The proper quantity of the coating can ensure sufficient adhesion between the abnormally-shaped tobacco granules, and excessive coating cannot be used to prevent the introduction possible peculiar smell.

Further, the width of the groove is 40-120 μm, usually 60-100 μm, further 75-95 μm; and the width of the ridge is 50-150 μm, usually 60-130 μm, further 80-110 μm.

Further, the number of grooves and/or ridges is 2-20, usually 5-15, preferably 8-12.

Optionally, the abnormally-shaped tobacco granule is columnar, and the one or more grooves and/or ridges is uniformly distributed on the outer wall of the abnormally-shaped tobacco granule.

Optionally, the grooves are sharp grooves or arc grooves, and the size and number of the grooves are related to the size of the tobacco granule body and can be adjusted as needed; optionally, the through holes are circular or in any other shape.

Further, the tobacco granule body is in the shape of at least one of a column, a sheet and a ball, preferably in the shape of a ball, which can better ensure the stability of smoking resistance of the final product.

Preferably, the abnormally-shaped tobacco granule body is in the shape of a ball, with a granule size of 10-35 meshes.

In some embodiments of the present invention, the tobacco granule body includes, in parts by weight, 100 parts of tobacco raw material, 1-15 parts of tobacco extract, 5-30 parts of atomizing agent and 0-100 parts of first accessory. Preferably, the abnormally-shaped tobacco granules made of the tobacco granule bodies using this formula are suitable for the preparation of a heating non-burning tobacco product.

Further, the first accessory includes at least one of microcrystalline cellulose, denatured starch, dextrin, cellulose, sugar powder, calcium carbonate, and carbon powder. The first accessory facilitates the shaping of the abnormally-shaped tobacco granules, can reduce the consumption of tobacco ingredients, can serve as a carrier to adsorb the tobacco extract and the atomizing agent, is beneficial to the storage of granules and smoke producing body materials, and solves the problem of too high nicotine content when the granular smoke producing body is smoked.

In some embodiments of the present invention, the tobacco granule body includes, in parts by weight, 90-99 parts of tobacco raw material, 0.01-1 part of flavor, 0.1-5 parts of humectant and 0-5 parts of second accessory. Preferably, the abnormally-shaped tobacco granules made of the tobacco granule bodies using this formula are suitable for the preparation of an total-granule burnable cigarette.

Further, the second accessory includes at least one of sandalwood, agarwood and tea, further, the second accessory can also be other active materials with special harm reducing functions, such as nano materials. These materials that are difficult to use in tobacco shred cigarettes can be well applied to granule cigarettes, and give the cigarettes with more functions and characteristics.

Further, the coating includes one or more of hydroxypropyl methyl cellulose, hydroxypropyl cellulose, polyvidone, sodium carboxymethyl cellulose, polyethylene glycol, polyvinyl alcohol, starch, and dextrin. The coating can provide an adhesive force necessary to bond the abnormally-shaped tobacco granules during shaping. Meanwhile, the coating can isolate the tobacco granule body from the outside to achieve a protective effect, and enables the granules to have better appearance and fluidity.

Further, the flavor can be a conventional cigarette flavor, tobacco extract, andextractum. And the flavor can also be solid flavor powder, or the like.

Further, the humectant is one or more of maltooligosaccharide, D-galactopyranouronic acid, chitosan derivative, propylene glycol, glycerol, sorbitol, xylitol, and the like.

Further, the tobacco raw material is one or more of tobacco sheets, tobacco shreds or tobacco stems, and can be of a single formulation or a mixed formulation. For the single formulation, the abnormally-shaped tobacco granules prepared by different formulations can be mixed according to a proportion to prepare a granular tobacco product.

Further, the bulk density of the abnormally-shaped tobacco granules is 0.2-0.8 g/cm$^3$, further 0.2-0.6 g/cm$^3$.

Proper granule size and bulk density help to ensure that the total-granule cigarette has suitable smoking resistance and good thermal conductivity or flammability, and ensure smooth smoking and fast smoke production.

A preparation method of the abnormally-shaped tobacco granules includes the following steps:

S1, selecting or designing a mold according to the shape of tobacco granule bodies, and installing the mold to an extrusion molding machine;

S2, injecting raw materials into a feed port of the extrusion molding machine, and performing extrusion molding, cutting and drying to obtain tobacco granule bodies; and S3, coating the tobacco granule bodies to obtain the abnormally-shaped tobacco granules.

Further, in S2, drying is carried out at a low temperature of 50° C. or lower.

Further, S2 and S3 include a screening step, and preferably, tobacco granule bodies of 15-45 meshes are screened.

In some embodiments of the present invention, the preparation of abnormally-shaped tobacco granules, especially suitable for heating non-burning cigarettes, includes the following steps:

S1, based on weight parts, pulverizing 100 parts of tobacco raw material into tobacco powder with a diameter of less than 60 meshes, adding 0-100 parts of first accessory, and stirring uniformly to obtain a mixture;

mixing 1-15 parts of tobacco extract, 5-30 parts of atomizing agent and 10-50 parts of 40-90 vol % ethanol solution uniformly, spraying to the mixture, and stirring uniformly to obtain a raw material;

selecting or designing a mold according to the shape of tobacco granule bodies and relevant parameters, and installing the mold to an extrusion molding machine;

S2, injecting the raw material obtained in S1 into a feed port of the extrusion molding machine, and performing extrusion molding, cutting and drying to obtain tobacco granule bodies; and S3, coating the tobacco granule bodies to obtain the abnormally-shaped tobacco granules.

In some embodiments of the present invention, the preparation of abnormally-shaped tobacco granules, especially suitable for total-granule burnable cigarettes, includes the following steps:

S1, based on weight parts, pulverizing 90-99 parts of tobacco raw material into tobacco powder with a diameter of less than 60 meshes, adding 0-5 parts of second accessory, and stirring uniformly to obtain a mixture;

mixing 0.01-1 part of flavor, 0.1-5 parts of humectant and 10-50 parts of 30-90 vol % ethanol solution uniformly, spraying to the mixture, and stirring uniformly to obtain a raw material; selecting or designing a mold according to the shape of tobacco granule bodies and relevant parameters, and installing the mold to an extrusion molding machine;

S2, injecting the raw material obtained in S1 into a feed port of the extrusion molding machine, and performing extrusion molding, cutting and drying to obtain tobacco granule bodies; and S3, coating the tobacco granule bodies to obtain the abnormally-shaped tobacco granules.

A tobacco product is mainly formed by tobacco granules, the tobacco granules including abnormally-shaped tobacco granules as described above, or abnormally-shaped tobacco granules prepared by the preparation method as described above.

Further, the density of the tobacco product is 0.3-1.2 g/cm$^3$, further 0.3-0.7 g/cm$^3$. The proper rod density of the tobacco product helps to ensure that the granule cigarette has proper smoking resistance, and good thermal conductivity or flammability and smoke producing speed.

Preferably, the density of the total-granule tobacco product is 0.3-0.7 g/cm$^3$. The proper density helps to ensure that the total-granule tobacco product has suitable proper smoking resistance, good flammability and smoking puffs.

The total-granule tobacco product of the present invention can be ignited for smoking as conventional tobacco shred cigarettes, and the tobacco raw material can also be further treated to obtain a smoke producing body of a heating non-burning cigarette.

Further, the tobacco product is in the shape of a solid rod, cake or hollow cylinder. The solid rod tobacco product can be used in peripheral heating smoking sets; the cake tobacco product can be used in bottom and/or peripheral heating smoking sets; the hollow cylinder tobacco product can be used in peripheral heating smoking sets, and its periphery and center can be synchronously heated to further improve the smoke producing speed, so that the consumer experience is better.

A preparation method of the tobacco product includes the following steps:

(1) heating and humidifying the abnormally-shaped tobacco granules with wet hot air to activate the adhesion of the coating on the surfaces of the abnormally-shaped tobacco granules to obtain wet hot abnormally-shaped tobacco granules;

wherein, the temperature of the wet hot air is 90-150° C., and the humidity is 95% to 100%;

(2) using the wet hot abnormally-shaped tobacco granules as a raw material, molding and removing excess water, thus obtaining a tobacco product blank; and (3) wrapping with cigarette paper, connecting cigarette filters, and cutting to obtain heating non-burning cigarettes and/or burnable cigarettes; or wrapping with cigarette paper and cutting to obtain a heating non-burning tobacco product.

Compared with the prior art, the beneficial effects of the present invention are:

1. The atomizing agent and tobacco extract inside the abnormally-shaped tobacco granules of the present invention are distributed uniformly, so the smoke producing stability and uniformity are better, smoke is sufficient, and the smoking experience is good.
2. Coating is carried out during the granulation process of the abnormally-shaped tobacco granules, which blocks the internal ingredients of the tobacco granule body from contacting the outside to a great extent, facilitates storage, and forms anti-seepage protection, thereby effectively solving the problem of liquid leakage.
3. The abnormally-shaped tobacco granules of the present invention can provide more gaps in rods when being further cured into rods, thereby reducing the smoking resistance and increasing the smoking experience.
4. The tobacco product of the present invention can be prepared by a cigarette machine, is similar to traditional cigarettes in shape, but is different from conventional tobacco shred or sheet heating non-burning cigarettes, can meet industrial requirements and bring consumers with novelty experience, and is more convenient to use.
5. The abnormally-shaped tobacco granules of the present invention have high strength and low bulk density, which can adapt to further machining, reduce the consumption of tobacco ingredients and the weight of cigarettes, and reduce the release of harmful ingredients.
6. The abnormally-shaped structure of the tobacco granules greatly improves the air permeability inside total-granule cigarettes, can ensure proper smoking resistance of cigarettes, and obviously improves the thermal conductivity or flammability.
7. The total-granule tobacco product prepared in the present invention has excellent homogenization, good stability and stable quality. The tobacco materials in the cigarette are mixed uniformly in the form of powder, and various accessory additives are mixed in the form of solutions or powder with the tobacco powder, which can achieve the best homogeneous effect, fundamentally solve the problem of poor quality stability of existing cigarette products, and give cigarettes with more functions and characteristics.
8. The structure and form of the total-granule tobacco product are very different from traditional cigarettes, so the smoking experience is strong, and a new experience can be brought to consumers.
9. The total-granule tobacco product prepared in the present invention has high hardness and structural strength, which solves the problem that conventional flexible cigarettes are easily damaged.

DETAILED DESCRIPTION OF EMBODIMENTS

The following examples are intended to illustrate the content of the present invention, not to further limit the protection scope of the present invention.

Example 1

Figure 1:
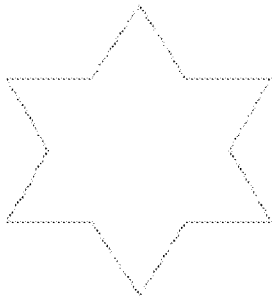
FIG. 1 is a schematic cross-sectional view of a abnormally-shaped tobacco granule in Examples 1, 4 and 7 of the present invention.

A preparation method of abnormally-shaped tobacco granules in this embodiment included the following steps:

1) a tobacco raw material was mechanically pulverized into tobacco powder of less than 60 meshes; 2) a tobacco extract, propylene glycol, and 50 vol % alcohol were mixed uniformly in a mass ratio of 1:5:10 to obtain a mixed solution; 3) the mixed solution and the tobacco powder were mixed uniformly in a mass ratio of 25:75 to form a soft material; 4) the soft material was extruded into strips by means of a mold with six sharp bulges at edges of extrusion holes, the strips were cut into small granules, and the small granules were stood for 10 min, then dried at a low temperature of 60° C., further shaped, and screened to select granules of 15-35 meshes; and 5) a 10% polyvidone solution was prepared, and the prepared granules were coated to obtain required abnormally-shaped tobacco granules, wherein the coating was 0.5% of the weight of the abnormally-shaped tobacco granule, the bulk density of the abnormally-shaped tobacco granules was 0.60 g/cm$^3$, and the schematic cross-sectional view of the granules was shown in FIG. 1.

A preparation method of a total-granule low temperature smoke producing body included: the prepared abnormally-shaped tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into heating non-burning granule cigarettes with proper length like traditional cigarettes.

Example 2

Figure 2:
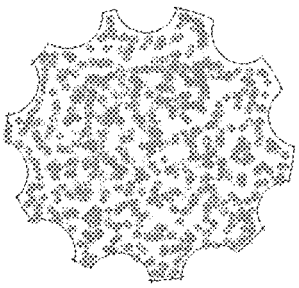
FIG. 2 is a schematic cross-sectional view of a abnormally-shaped tobacco granule in Examples 2 and 5 of the present invention.

A preparation method of abnormally-shaped tobacco granules in this embodiment included the following steps:

1) a tobacco material was mechanically pulverized into tobacco powder of less than 60 meshes; 2) a tobacco extract, propylene glycol, glycerin, and 75 vol % alcohol were mixed uniformly in a mass ratio of 2:5:5:15; 3) the mixed solution and the tobacco powder were mixed uniformly in a mass ratio of 30:70 to form a soft material; 4) the soft material was extruded into strips by means of a mold with ten arc bulges at edges of extrusion holes, the strips were cut into small granules, and the small granules were stood for 10 min, then dried at a low temperature of 60° C., further shaped, and screened to select granules of 15-35 meshes; and 5) a 8% polyvinyl alcohol solution was prepared, and the prepared granules were coated to obtain required abnormally-shaped tobacco granules, wherein the coating was 1.5% of the weight of the abnormally-shaped tobacco granule, the bulk density of the abnormally-shaped tobacco granules was 0.65 g/ml, and the schematic cross-sectional view of the granules was shown in FIG. 2.

A preparation method of a total-granule low temperature smoke producing body included: the prepared abnormally-shaped tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into heating non-burning granule cigarettes with proper length like traditional cigarettes.

Example 3

Figure 3:
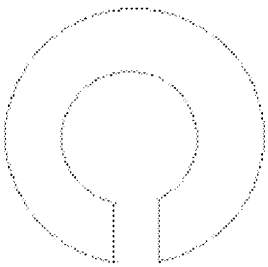
FIG. 3 is a schematic cross-sectional view of a abnormally-shaped tobacco granule in Examples 3 and 6 of the present invention.

A preparation method of abnormally-shaped tobacco granules in this embodiment included the following steps:

1) a tobacco raw material was mechanically pulverized into tobacco powder of less than 60 meshes; 2) a tobacco extract, propylene glycol, glycerine, and 75 vol % alcohol were mixed uniformly in a mass ratio of 2:5:10:105; 3) the mixed solution was mixed uniformly with microcrystalline cellulose in a mass ratio of 1:3 to prepare a wet material; 4) the wet material and the tobacco powder were mixed uniformly in a mass ratio of 1:1 to prepare a soft material; 5) the soft material was extruded into strips by means of a mold with solid cakes in centers of extrusion holes, the strips were cut into small granules, and the small granules were stood for 10 min, then dried at a low temperature of 60° C., further shaped, and screened to select granules of 15-35 meshes as tobacco granule bodies; and 6) a 10% mixed solution was prepared wherein the mass ratio of polyethylene glycol and polyvidone is 1:1, and the prepared tobacco granules were coated to obtain required abnormally-shaped tobacco granules, wherein the coating was 1% of the weight of the abnormally-shaped tobacco granule, the bulk density of the abnormally-shaped tobacco granules was 0.75 g/ml, and the schematic cross-sectional view of the granules was shown in FIG. 3.

A preparation method of a total-granule low temperature smoke producing body included: the prepared abnormally-shaped tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into heating non-burning granule cigarettes with proper length like traditional cigarettes.

Example 4

A preparation method of abnormally-shaped tobacco granules in this embodiment included the following steps:

1) a tobacco raw material was mechanically pulverized into tobacco powder of less than 80 meshes; 2) based on mass parts, 0.02 part of cigarette flavor and 0.1 part of maltooligosaccharide were added to 20 parts of 75 vol % alcohol, followed by uniform stirring, uniform spraying to 100 parts of tobacco powder, and uniform stirring to obtain a soft tobacco material; 3) the soft tobacco material was extruded into strips by means of a mold with six sharp bulges at edges of extrusion holes, the strips were cut into small granules, and the small granules were stood for 10 min, then dried at a low temperature of 60° C., further shaped, and screened to select granules of 15-35 meshes; and 4) a 10% polyvidone solution was prepared, and the prepared granules were coated to obtain required abnormally-shaped tobacco granules, wherein the coating was 0.5% of the weight of the abnormally-shaped tobacco granule, the bulk density of the granules was 0.55 g/ml, and the schematic cross-sectional view of the granules was shown in FIG. 1.

A preparation method of total-granule cigarettes included: the abnormally-shaped tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into total-granule cigarettes with proper length like traditional cigarettes.

Example 5

A preparation method of abnormally-shaped tobacco granules in this embodiment included the following steps:

1) a tobacco raw material was mechanically pulverized into tobacco powder of less than 80 meshes; 2) based on mass parts, 0.05 part of cigarette flavor and 0.4 part of D-galactopyranouronic acid were added to 30 parts of 50 vol % alcohol, followed by uniform stirring, uniform spraying to 100 parts of tobacco powder, and uniform stirring to obtain a soft tobacco material; 3) the soft tobacco material was extruded into strips by means of a mold with ten arc bulges at edges of extrusion holes, the strips were cut into small granules, and the small granules were stood for 20 min, then dried at a low temperature of 60° C., further shaped, and screened to select granules of 15-35 meshes; and 4) a 8% polyvinyl alcohol solution was prepared, and the prepared granules were coated to obtain required abnormally-shaped tobacco granules, wherein the coating was 1% of the weight of the abnormally-shaped tobacco granule, the bulk density of the granules was 0.65 g/ml, and the schematic cross-sectional view of the granules was shown in FIG. 2.

A preparation method of total-granule cigarettes included: the abnormally-shaped tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into total-granule cigarettes with proper length like traditional cigarettes.

Example 6

A preparation method of abnormally-shaped tobacco granules in this embodiment included the following steps:

1) a tobacco raw material was mechanically pulverized into tobacco powder of less than 80 meshes; 2) based on mass parts, 0.08 part of cigarette flavor, 0.2 part of D-galactopyranouronic acid and 0.3 part of glycerin were added to 30 parts of 50 vol % alcohol, followed by uniform stirring, uniform spraying to mixed powder of 100 parts of tobacco powder and 1 part of nano iron oxide, and uniform stirring to obtain a soft tobacco material; 3) the soft tobacco material was extruded into strips by means of a mold with solid cakes in centers of extrusion holes, the strips were cut into small granules, and the small granules were stood for 20 min, then dried at a low temperature of 60° C., further shaped, and screened to select granules of 15-35 meshes; and 4) a 10% mixed solution was prepared wherein the mass ratio of polyethylene glycol and povidone is 1:1, and the prepared granules were coated to obtain required abnormally-shaped tobacco granules, wherein the coating was 1% of the weight of the abnormally-shaped tobacco granule, the bulk density of the granules was 0.45 g/ml, and the schematic cross-sectional view of the granules was shown in FIG. 3.

A preparation method of total-granule cigarettes included: the abnormally-shaped tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into total-granule cigarettes with proper length like traditional cigarettes.

Comparative Example 1

In order to compare the differences of smoke producing bodies prepared from abnormally-shaped tobacco granules and conventional tobacco granules, the conventional tobacco granules were prepared in this example according to the proportion and steps of Example 1, including the following steps:

1) a tobacco raw material was mechanically pulverized into tobacco powder of less than 60 meshes; 2) a tobacco extract, propylene glycol, and 50 vol % alcohol were mixed uniformly in a mass ratio of 1:5:10 to obtain a mixed solution; 3) the mixed solution and the tobacco powder were mixed uniformly in a mass ratio of 25:75 to form a soft material; 4) the soft material was extruded into strips by means of a conventional round hole mold, the strips were cut into small granules, and the small granules were stood for 10 min, then dried at a low temperature of 60° C., further shaped, and screened to select granules of 15-35 meshes; and 5) a 10% polyvidone solution was prepared, and the prepared granules were coated to obtain required tobacco granules, wherein the coating was 0.5% of the weight of the tobacco granule, the bulk density of the tobacco granules was 0.75 g/cm$^3$, and the schematic cross-sectional view of the granules was shown in FIG. 1.

A preparation method of a total-granule low temperature smoke producing body included: the prepared tobacco granules were conveyed to a conveyor belt of a granule hot-curing molding device via a quantitative adding system, and the feed was further controlled via a flow limiting valve to enter a granule hot-curing molding cavity; the granules were quickly heated and humidified under the action of high-temperature water vapor, the surface adhesive coating was activated, and the loose granules were quickly bonded into continuous wet cigarette rods under negative pressure; the wet cigarette rods quickly lost moisture and were cooled and cured into total-granule cigarette rods under the action of a cooling and moisture discharge system; and the total-granule cigarette rods were conveyed to a cigarette gun of a subsequent cigarette making machine by a conveying system, then wrapped with cigarette paper, cooled, wrapped with tipping paper, and cut into heating non-burning granule cigarettes with proper length like traditional cigarettes.

| Sample | Smoking evaluation |
|---|---|
| Example 1 | Smooth smoking, relatively fast smoke producing speed, relatively sufficient smoke, relatively good fragrance |
| Example 2 | Smooth smoking, fast smoke producing speed, sufficient smoke, relatively good fragrance |
| Example 3 | Smooth smoking, fast smoke producing speed, very sufficient smoke, good fragrance |
| Example 4 | Smooth smoking, relatively fast smoke producing speed, adequate smoke, relatively good fragrance |
| Example 5 | Smooth smoking, relatively fast smoke producing speed, adequate smoke, relatively good fragrance |
| Example 6 | Smooth smoking, relatively fast smoke producing speed, adequate smoke, relatively good fragrance |
| Comparative Example 1 | Not very smooth smoking, relatively slow smoke producing speed, relatively adequate smoke, relatively good fragrance |

The contents illustrated by the above examples should be understood as these examples are merely used for illustrating the present invention more clearly, rather than limiting the scope of the present invention. Various equivalent modifications made to the present invention by those skilled in the art after reading the present invention all fall within the scope defined by the appended claims of the present application.

The invention claimed is:

1. A tobacco product, mainly formed by tobacco granules, wherein the tobacco granules comprise a plurality of abnormally-shaped tobacco granules, an abnormally-shaped tobacco granule of the plurality of abnormally-shaped tobacco granules comprising a tobacco granule body and a coating wrapped around a surface of the tobacco granule body, wherein:

the tobacco granule body comprises, in parts by weight, 100 parts of tobacco raw material, 1-15 parts of tobacco extract, 5-30 parts of atomizing agent, and 0-100 parts of a first accessory; or 90-99 parts of tobacco raw material, 0.01-1 part of flavor, 0.1-5 parts of humectant, and 0-5 parts of a second accessory;

the coating contains an adhesive, wherein the coating comprises one or more of hydroxypropyl methyl cellulose, hydroxypropyl cellulose, polyvidone, sodium carboxymethyl cellulose, polyethylene glycol, polyvinyl alcohol, starch, and dextrin, therefore the plurality of abnormally-shaped tobacco granules are bonded and form a total-granule cigarette rod; and a surface of the abnormally-shaped tobacco granule has one or more grooves and/or one or more ridges, and/or;

the abnormally-shaped tobacco granule has through holes therein.

2. The tobacco product according to claim 1, wherein:

the tobacco product is in a shape of a solid rod, cake or hollow cylinder, and optionally, a density of the tobacco product is 0.3-1.2 g/cm3.

3. A preparation method of the tobacco product according to claim 1, comprising the following steps:

(1) heating and humidifying the abnormally-shaped tobacco granules with wet hot air to activate the adhesion of the coating on the surfaces of the abnormally-shaped tobacco granules to obtain wet hot abnormally-shaped tobacco granules; wherein, the temperature of the wet hot air is 90-150° C., and the humidity is 95% to 100%;

(2) using the wet hot abnormally-shaped tobacco granules as a raw material, molding and removing excess water, thus obtaining a tobacco product blank; and (3) wrapping with cigarette paper, connecting cigarette filters, and cutting to obtain the tobacco product.

4. The tobacco product according to claim 1, wherein:

the surface of the abnormally-shaped tobacco granule has the one or more grooves and the one or more ridges:

a groove of the one or more grooves has a width of 40-120 μm; and a ridge of the one or more ridges has a width of 50-150 μm.

5. The tobacco product according to claim 1, wherein the tobacco granule body is in a shape of at least one of a column, a sheet, and a ball.

6. The tobacco product according to claim 1, wherein:

the first accessory comprises at least one of microcrystalline cellulose, denatured starch, dextrin, cellulose, sugar powder, calcium carbonate, and carbon powder.

7. The tobacco product according to claim 1, wherein:

the second accessory comprises at least one of sandalwood, agarwood, and tea.

8. The tobacco product according to claim 1, wherein a bulk density of the plurality of abnormally-shaped tobacco granules is 0.2-0.8 g/cm3.

9. A preparation method of the tobacco product according to claim 1, comprising the following steps:

S1, selecting or designing a mold according to a shape of tobacco granule bodies, and installing the mold to an extrusion molding machine;

S2, injecting raw materials into a feed port of the extrusion molding machine, and performing extrusion molding, cutting and drying to obtain tobacco granule bodies; and S3, coating the tobacco granule bodies to obtain abnormally-shaped tobacco granules.

10. The preparation method according to claim 9, wherein step S1 comprises:

based on weight parts, pulverizing 100 parts of tobacco raw material into tobacco powder with a diameter of less than 60 meshes, adding 0-100 parts of first accessory, and stirring uniformly to obtain a mixture;

mixing 1-15 parts of tobacco extract, 5-30 parts of atomizing agent and 10-50 parts of 40-90 vol % ethanol solution uniformly, spraying to the mixture, and stirring uniformly to obtain a raw material; and selecting or designing a mold according to the shape of tobacco granule bodies and relevant parameters, and installing the mold to an extrusion molding machine.

11. The preparation method according to claim 9, wherein step S1 comprises:

based on weight parts, pulverizing 90-99 parts of tobacco raw material into tobacco powder with a diameter of less than 60 meshes, adding 0-5 parts of second accessory, and stirring uniformly to obtain a mixture;

mixing 0.01-1 part of flavor, 0.1-5 parts of humectant and 10-50 parts of 30-90 vol % ethanol solution uniformly, spraying to the mixture, and stirring uniformly to obtain a raw material; and selecting or designing a mold according to the shape of tobacco granule bodies and relevant parameters, and installing the mold to an extrusion molding machine.

12. The preparation method according to claim 9, further comprising the following steps:

(1) heating and humidifying the abnormally-shaped tobacco granules with wet hot air to activate the adhesion of the coating on the surfaces of the abnormally-shaped tobacco granules to obtain wet hot abnormally-shaped tobacco granules; wherein, the temperature of the wet hot air is 90-150° C., and the humidity is 95% to 100%;

(2) using the wet hot abnormally-shaped tobacco granules as a raw material, molding and removing excess water, thus obtaining a tobacco product blank; and (3) wrapping with cigarette paper, connecting cigarette filters, and cutting to obtain the tobacco product.

* * * * *